US009510666B1

(12) United States Patent
Lai

(10) Patent No.: US 9,510,666 B1
(45) Date of Patent: Dec. 6, 2016

(54) TRAINING TOOTHBRUSH

(71) Applicant: Shyh-Jen Lai, New Taipei (TW)

(72) Inventor: Shyh-Jen Lai, New Taipei (TW)

( * ) Notice: Subject to any disclaimer, the term of this patent is extended or adjusted under 35 U.S.C. 154(b) by 0 days.

(21) Appl. No.: 14/826,299

(22) Filed: Aug. 14, 2015

(51) Int. Cl.
*A46B 9/04* (2006.01)
*A46B 5/02* (2006.01)

(52) U.S. Cl.
CPC ..... *A46B 9/04* (2013.01); *A46B 5/023* (2013.01); *A46B 9/045* (2013.01)

(58) Field of Classification Search
CPC ..... A46B 9/045; A46B 9/026
USPC ..... 15/167.2
See application file for complete search history.

(56) References Cited

U.S. PATENT DOCUMENTS

D196,635 S * 10/1963 Kinsella ..... 15/167.1
5,615,443 A * 4/1997 Lai ..... A46B 9/045 15/145
8,635,731 B2 * 1/2014 Garner ..... A46B 9/045 15/22.1
2004/0074035 A1 * 4/2004 Huang ..... A46B 3/005 15/167.2
2013/0067665 A1 * 3/2013 Sowinski ..... A61C 17/228 15/4

* cited by examiner

*Primary Examiner* — Laura C Guidotti
(74) *Attorney, Agent, or Firm* — Jackson IPG PLLC; Demian K. Jackson

(57) ABSTRACT

A training toothbrush is for a user to hold its handle and to have his/her upper and lower tooth rows engaging with respective tooth-accommodating indentations while gliding the training toothbrush to and fro along curves of his/her upper and lower tooth rows. At the rear ends of the user's upper and lower tooth rows, the training toothbrush uses flexible tooth-cleaning bristles to scrub laterals of teeth at the ends of the upper and lower tooth rows. When the user glides the training toothbrush, its flexible connecting plates radially wiggle, and at the same time the flexible tooth-cleaning bristles are driven to axially move outward, thereby effectively cleaning the laterals of teeth at the ends of the upper and lower tooth rows.

2 Claims, 4 Drawing Sheets

TRAINING TOOTHBRUSH

BACKGROUND OF THE INVENTION

1. Technical Field

The present invention related to tooth-cleaning tools, and more particularly to a training toothbrush.

2. Description of Related Art

For good dental care, it is important to not only clean one's oral cavity every morning and night, but also clean all his/her teeth after every meal. Immediate cleaning helps to remove food debris so as to prevent debris from spoiling and breeding bacteria that are injurious to teeth. In particular, young children have deciduous teeth fragile and sensitive, and for them such cleaning regimen must be done thoroughly. Otherwise dental caries and pathological changes on teeth or gums tend to happen and bring about problems to their oral health, dietetic hygiene, and even their future permanent teeth.

There are tooth-cleaning tools commonly used. For example, toothbrushes have bristles that scrub teeth and dental floss or floss rods can clean the contact between teeth. Also, mouthwash is uses for washing the mouth. However, the foregoing articles are designed to be used by adults and older children, and are less applicable to tooth cleaning for young children.

For addressing the above-mentioned problem, the inventor of the present invention has earlier proposed an omnibearing dental care device published as Taiwan Patent No. M307391. The prior-art device is composed of a flexible tooth-cleaning body and some guiding tubes. Therein, the tooth-cleaning body has its top formed as a curved teeth-cleaning portion. The end of the teeth-cleaning portion has an I-shaped cross-section. In the I-shaped structure, there are grooves. Vertical bristles are implanted at the bottom of the grooves, and inclined bristles are arranged at inner and outer edges of the walls of the grooves. The known device is equipped with a handle that designed to be easily held by a young child. Thus, when a young child chews the device, the bristles scrub and clean teeth.

While the omnibearing dental care device having the flexible tooth-cleaning body is applicable to young children like a training toothbrush for the teeth-cleaning purpose, the bristles, limited to their arrangement, fail to reach the molar teeth deep in the mouth. As a result, the cleaning it can achieve is less complete. Once debris and sordes accumulate at the molar teeth, the oral health is endangered.

SUMMARY OF THE INVENTION

For addressing the problem described previously, it is one objective of the present invention to provide a training toothbrush. In use, a user can hold the training toothbrush's handle and have his/her upper and lower tooth rows engaging with respective tooth-accommodating indentations while gliding the training toothbrush to and fro along curves of his/her upper and lower tooth rows. The a training toothbrush uses its first and second flexible tooth-cleaning bristles to clean the user's upper and lower tooth rows, respectively. At the rear ends of the user's upper and lower tooth rows, the training toothbrush uses the third flexible tooth-cleaning bristles of the second tooth-cleaning member to scrub laterals of teeth at the ends of the upper and lower tooth rows. Since the two connecting plates of the second tooth-cleaning member are made of flexible material and set apart, when the user glides the training toothbrush, the connecting plates radially wiggle, and at the same time the third flexible tooth-cleaning bristles are driven to axially move outward, thereby effectively cleaning the laterals of teeth at the ends of the upper and lower tooth rows.

The present invention provides a training toothbrush, comprising a first tooth-cleaning member being made of flexible material and having an inner curved portion, a connecting portion, and an outer curved portion, the connecting portion being curved to fit human teeth, the inner curved portion being connected to an inner side connecting portion, and the outer curved portion being connected to an outer side of the connecting portion, the first tooth-cleaning member having an I-shaped radial cross-section, each of left and right sides of the connecting portion together with the inner curved portion and the outer curved portion defining a tooth-accommodating indentation, in each of the tooth-accommodating indentation a plurality of first flexible tooth-cleaning bristles being formed on a surface of the connecting portion, and a plurality of second flexible tooth-cleaning bristles being formed on a surface of the inner curved portion and on a surface of the outer curved portion; a second tooth-cleaning member being made of flexible material and having two connecting plates and a plurality of third flexible tooth-cleaning bristles, each of the connecting plates being attached to a top of the first tooth-cleaning member and having two ends thereof connected to a top of the inner curved portion and a top of the outer curved portion, respectively, and the two connecting portions being parallel to and separated from each other, each of the third flexible tooth-cleaning bristles extending from the corresponding connecting plate outward to either side of the training toothbrush; and a handle extending outward from a bottom of the outer curved portion of the first tooth-cleaning member and being made of flexible material.

In some embodiments, the second flexible tooth-cleaning bristles are inclined toward an opening of the corresponding tooth-accommodating indentation.

DETAILED DESCRIPTION OF THE INVENTION

Figure 1:
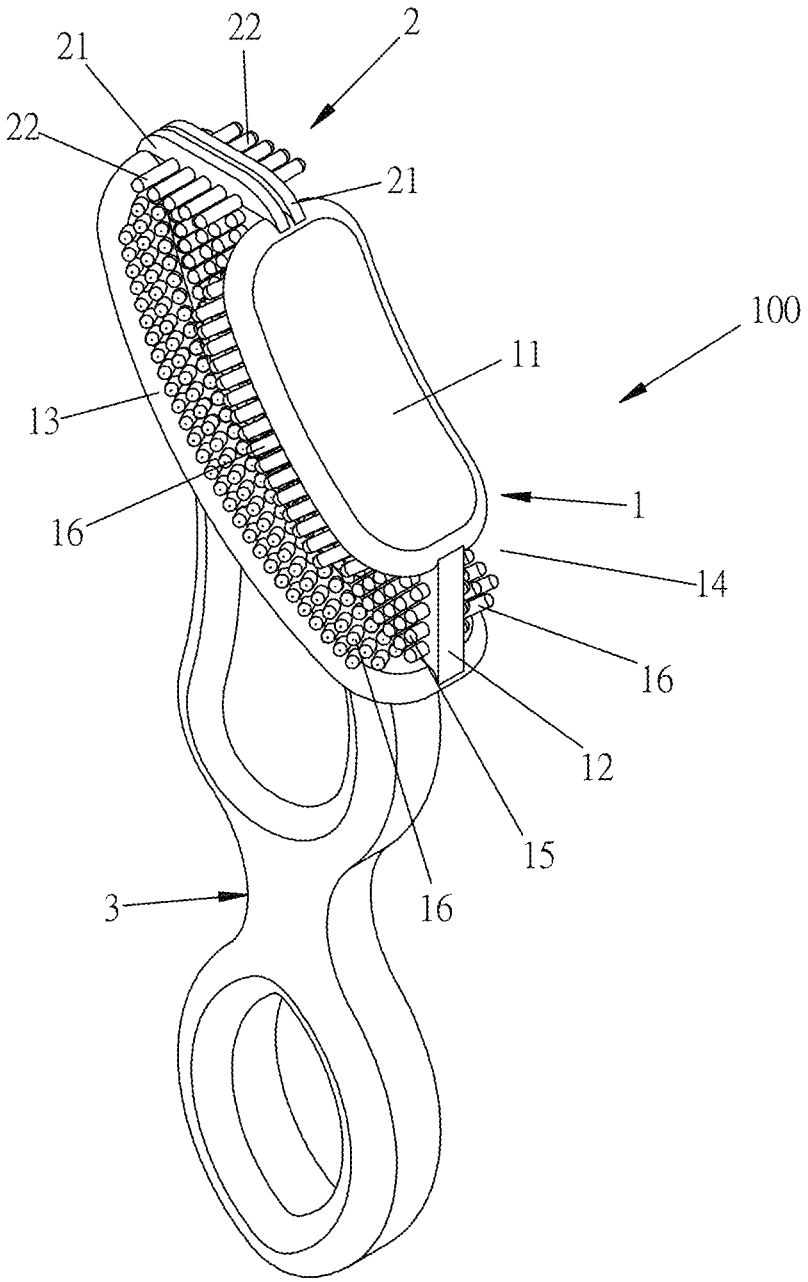
FIG. 1 is a perspective view of a training toothbrush according to the present invention.
Figure 2:
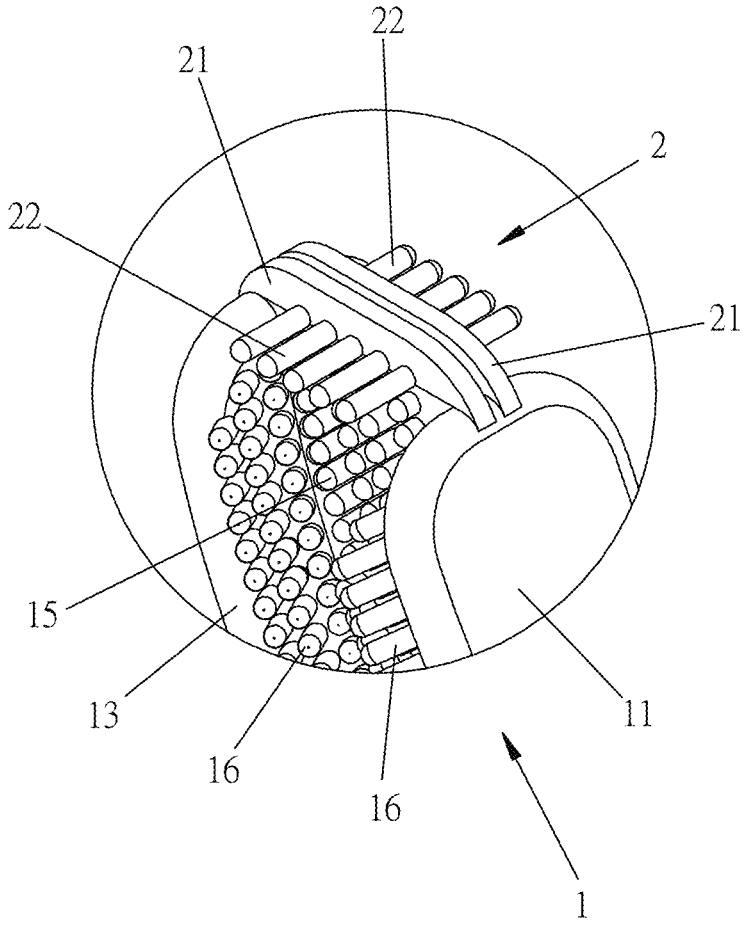
FIG. 2 is a partial, enlarged view of the training toothbrush of FIG. 1.
Figure 3:
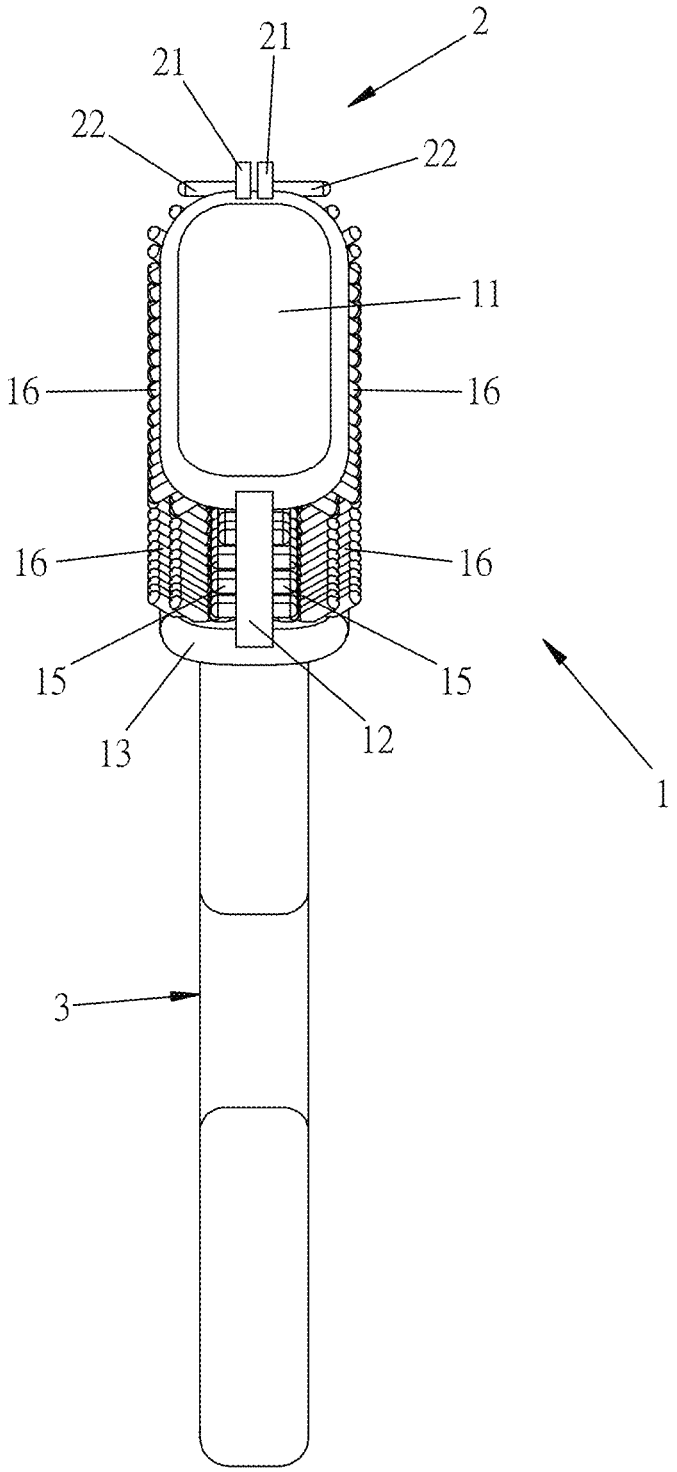
FIG. 3 is a front view of the training toothbrush of FIG. 1.
Figure 4:
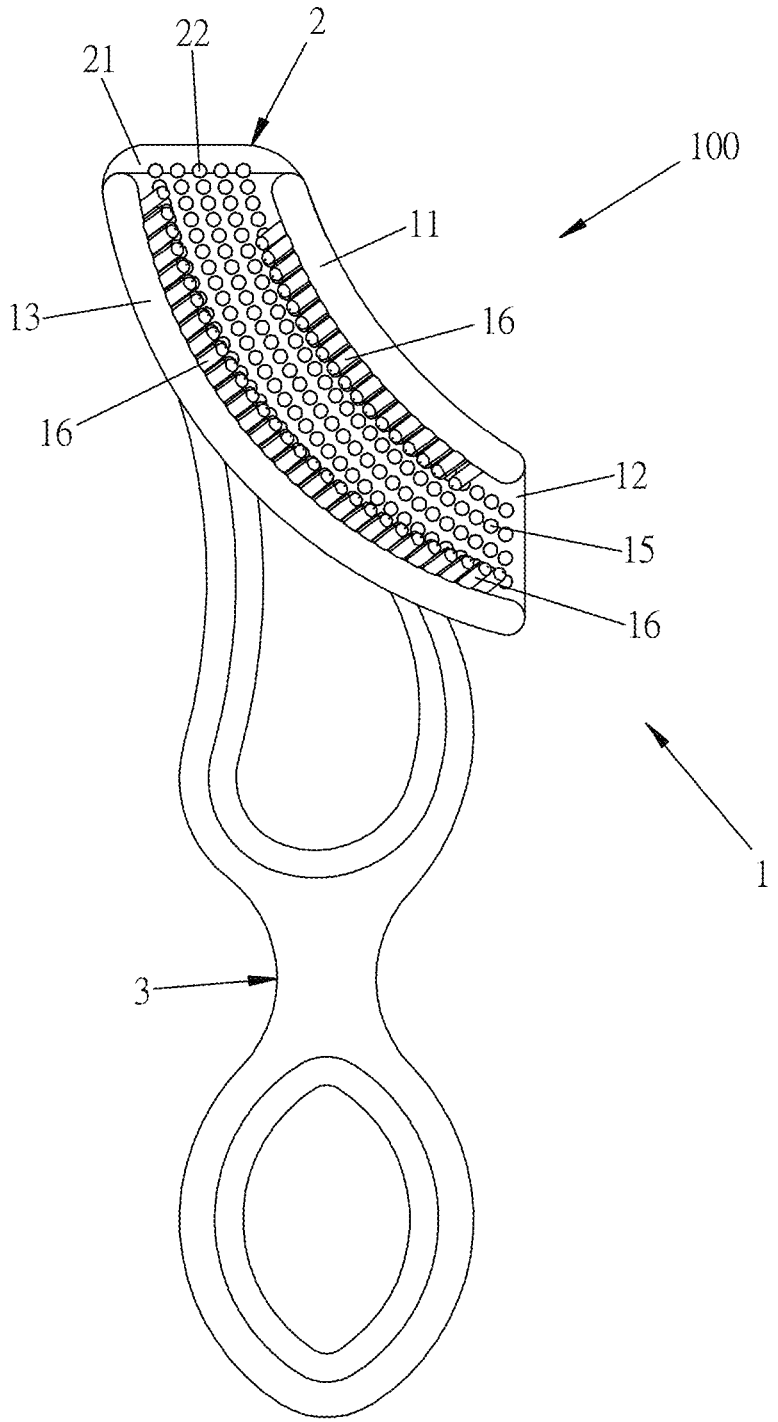
FIG. 4 is a side view of the training toothbrush of FIG. 1.

Referring to FIG. 1 and FIG. 4, in the present invention, a training toothbrush 100 comprises a first tooth-cleaning member 1, a second tooth-cleaning member 2, and a handle 3.

The first tooth-cleaning member 1 is made of flexible material and has an inner curved portion 11, a connecting portion 12, and an outer curved portion 13. The connecting portion 12 is curved to fit human teeth. The inner curved portion 11 is connected to an inner side connecting portion 12, and the outer curved portion 13 is connected to an outer side of the connecting portion 12. The first tooth-cleaning member 1 has an I-shaped radial cross-section. Each of left and right sides of the connecting portion 12 together with the inner curved portion 11 and the outer curved portion 13 defines a tooth-accommodating indentation 14. In each of the tooth-accommodating indentation 14, a plurality of first flexible tooth-cleaning bristles 15 is formed on the surface of the connecting portion 12, and a plurality of second flexible tooth-cleaning bristles 16 is formed on the surface of the inner curved portion 11 and on the surface of the outer curved portion 13.

Therein, each of the second flexible tooth-cleaning bristles 16 is inclined toward an opening of the corresponding tooth-accommodating indentation 14.

The second tooth-cleaning member 2 is made of flexible material and has two connecting plates 21 and a plurality of third flexible tooth-cleaning bristles 22. Each of the connecting plates 21 is attached to the top of the first tooth-cleaning member 1 and has its two ends connected to the top of the inner curved portion 11 and the top of the outer curved portion 13, respectively. The two connecting portions 21 are parallel to and separated from each other. Each of the third flexible tooth-cleaning bristles 22 extends from the corresponding connecting plate 21 outward to either side of the training toothbrush 100.

The handle 3 extends outward from the bottom of the outer curved portion 13 of the first tooth-cleaning member 1, and may be made of flexible material.

In use, a user can hold the training toothbrush's handle 3 and have his/her upper and lower tooth rows engaging with respective tooth-accommodating indentations 14 while gliding the training toothbrush 100 to and fro along curves of his/her upper and lower tooth rows, so that the first flexible tooth-cleaning bristles 15 and the second flexible tooth-cleaning bristles 16 scrub the upper and lower tooth rows, respectively. At the rear ends of the user's upper and lower tooth rows, the training toothbrush 100 uses the third flexible tooth-cleaning bristles 22 of the second tooth-cleaning member 2 to scrub laterals of teeth at the ends of the upper and lower tooth rows. Since the two connecting plates 21 are made of flexible material and set apart, when the user glides the training toothbrush 100, the connecting plates 21 radially wiggle, and at the same time the third flexible tooth-cleaning bristles 22 are driven to axially move outward, thereby effectively cleaning the laterals of teeth at the ends of the upper and lower tooth rows.

What is claimed is:

1. A training toothbrush, at least comprising a first tooth-cleaning member and a handle, the first tooth-cleaning member being made of flexible material and having an inner curved portion, a connecting portion, and an outer curved portion, the connecting portion being curved to fit human teeth, the inner curved portion being connected to an inner side connecting portion, and the outer curved portion being connected to an outer side of the connecting portion, the first tooth-cleaning member having an I-shaped radial cross-section, each of left and right sides of the connecting portion together with the inner curved portion and the outer curved portion defining a tooth-accommodating indentation, in each of the tooth-accommodating indentation a plurality of first flexible tooth-cleaning bristles being formed on a surface of the connecting portion, and a plurality of second flexible tooth-cleaning bristles being formed on a surface of the inner curved portion and on a surface of the outer curved portion; and the handle extending outward from a bottom of the outer curved portion of the first tooth-cleaning member and being made of flexible material; the training toothbrush being characterized in:

further comprising a second tooth-cleaning member being made of flexible material and having two connecting plates and a plurality of third flexible tooth-cleaning bristles, each of the connecting plates being attached to a top of the first tooth-cleaning member and having two ends thereof connected to a top of the inner curved portion and a top of the outer curved portion, respectively, and the two connecting portions being parallel to and separated from each other, each of the third flexible tooth-cleaning bristles extending from the corresponding connecting plate outward to either side of the training toothbrush.

2. The training toothbrush of claim 1, wherein each of the second flexible tooth-cleaning bristles is inclined toward an opening of the corresponding tooth-accommodating indentation.

* * * * *